US008574031B2

(12) United States Patent
Dibner et al.

(10) Patent No.: US 8,574,031 B2
(45) Date of Patent: Nov. 5, 2013

(54) METHOD OF AND APPARATUS FOR GRINDING CYLINDRICAL AND CURVED SURFACES

(75) Inventors: Benjamin Dibner, Ulm (DE); Roland Schmitz, Vaihingen (DE)

(73) Assignee: EMAG Holding GmbH, Salach (DE)

( * ) Notice: Subject to any disclaimer, the term of this patent is extended or adjusted under 35 U.S.C. 154(b) by 411 days.

(21) Appl. No.: 12/826,748

(22) Filed: Jun. 30, 2010

(65) Prior Publication Data

US 2011/0053467 A1 Mar. 3, 2011

(30) Foreign Application Priority Data

Aug. 25, 2009 (DE) ..... 10 2009 038 817

(51) Int. Cl.
*B24B 5/42* (2006.01)

(52) U.S. Cl.
USPC ..... 451/49; 451/190; 451/194

(58) Field of Classification Search
USPC ..... 45/249, 399, 159, 160, 181, 49; 29/888.08; 451/49, 58, 62, 190, 194, 451/913, 249, 399, 159, 160, 181
IPC ..... B24B 5/42
See application file for complete search history.

(56) References Cited

U.S. PATENT DOCUMENTS

| | | | | | |
|---|---|---|---|---|---|
| 1,925,911 | A * | 9/1933 | Steiner | 451/49 |
| 3,748,925 | A * | 7/1973 | Stewart | 74/603 |
| 4,269,551 | A * | 5/1981 | Kralowetz | 409/132 |
| 4,603,514 | A * | 8/1986 | Suzuki et al. | 451/5 |
| 5,681,208 | A | 10/1997 | Junker | |
| 5,769,578 | A * | 6/1998 | Shimomura | 409/132 |
| 6,149,503 | A * | 11/2000 | Laycock | 451/49 |
| 6,878,043 | B1 * | 4/2005 | Junker | 451/49 |
| 7,530,882 | B2 * | 5/2009 | Soma et al. | 451/11 |
| 2009/0307886 | A1 * | 12/2009 | Chiba et al. | 29/90.01 |
| 2010/0107808 | A1 * | 5/2010 | Alderton et al. | 74/605 |

FOREIGN PATENT DOCUMENTS

| | | | |
|---|---|---|---|
| DE | 102004052342 | A | 5/2006 |
| JP | 08090408 | A * | 4/1996 |
| JP | 2000296445 | A * | 10/2000 |
| JP | 2006346802 | A * | 12/2006 |

* cited by examiner

*Primary Examiner* — Joseph J Hail
*Assistant Examiner* — Joel Crandall
(74) *Attorney, Agent, or Firm* — Andrew Wilford

(57) ABSTRACT

A workpiece has two cylindrical workpiece surfaces centered on respective parallel axes and each flanked by a pair of arcuately rounded and annular corners also centered on the respective axes. Some of the corners have a small radius of curvature and others of the corners have a large radius of curvature. The workpiece is held and rotated about a main axis parallel to the axis of one of the workpiece surfaces. A pair of grinders have wheels generally diametrally flanking the workpiece and each having a central cylindrical outer wheel surface centered on the respective wheel axis and a pair of arcuately rounded edge and surfaces also centered on the respective wheel axis. Two of the edge surfaces are the large radius and the other two of the small radius.

6 Claims, 5 Drawing Sheets

METHOD OF AND APPARATUS FOR GRINDING CYLINDRICAL AND CURVED SURFACES

FIELD OF THE INVENTION

The present invention relates to the grinding of cylindrical and curved surfaces. More particularly this invention concerns a grinding apparatus and method for a crankshaft whose main bearings and crankpins are of different radii.

BACKGROUND OF THE INVENTION

A method and an apparatus for grinding crankshafts in chucks are known from U.S. Pat. No. 5,681,208. Two different grinding disks are provided to grind the cylindrical end section of the crankshaft, the main bearing and the crankpins, and their radial surfaces. Since the grinding disks conform to the shapes of the bearing surfaces, they can be used only one after the other.

DE 10 2004 053 342 describes a method and apparatus for grinding a nonstraight workpiece that is chucked at both ends in a headstock and a tailstock, with at least two grinders that, together with a brace, are simultaneously used at least part of the time on the workpiece surface to be ground. Cylindrical workpiece surfaces are machined according to this method.

OBJECTS OF THE INVENTION

It is an object of the present invention to provide an improved method of and apparatus for grinding cylindrical and curved surfaces.

Another object is the provision of such an improved method of and apparatus for grinding cylindrical and curved surfaces that overcomes the above-given disadvantages, in particular that is particularly fast.

SUMMARY OF THE INVENTION

A workpiece has two cylindrical workpiece surfaces centered on respective parallel axes and each flanked by a pair of arcuately rounded and annular corners also centered on the respective axes. The corners flanking one of the cylindrical workpiece surfaces have a small radius of curvature and the corners flanking the other of the cylindrical workpiece surfaces have a large radius of curvature. The workpiece is held and rotated about a main axis parallel to the axis of one of the workpiece surfaces. A pair of grinders have wheels generally diametrally flanking the workpiece, each rotatable about a respective wheel axis parallel to the main axis, and having a central cylindrical outer wheel surface centered on the respective wheel axis and a pair of arcuately rounded edge and surfaces also centered on the respective wheel axis. Two of the edge surfaces have the large radius of curvature and the other two of the edge surfaces have the small radius of curvature. The grinders move parallel to the axes such that the small-radius edge surfaces are pressed axially into the small-radius corners and the large-radius edge surfaces are pressed axially into the large-radius corners while simultaneously both of the cylindrical outer wheel surfaces are pressed diametrally oppositely against the cylindrical workpiece surfaces.

This system is particularly effective for use with crankshafts where the main bearings normally have large-radius corners and the crankpins have small-radius corners. It is possible using the two same wheels to machine the cylindrical outer surfaces of the main bearings and of the crankpins and also all of their corners. There is no need to change grinding wheels, only to, for instance, use the wheel with the small-radius surfaces on the corners of the crankpins while bracing the crankpin oppositely with the wheel with the large-radius edges, and vice versa for the main bearings.

According to the invention both of the edge surfaces of one of the wheels are of the large radius of curvature and both of the edge surfaces of the other wheel are of the small radius of curvature. Thus with this system one wheel is used for all of the large-radius corners and the other for all of the small-radius corners. With this system the guide axially shifts one of the wheels while pressing it radially against the workpiece to grind the corners and holds the other wheel against axial movement so that this other wheel only braces the workpiece and machines its cylindrical surface.

Alternately in accordance with the invention one of the edge surfaces of each of the wheels is of the large radius of curvature and the other edge of each of the wheels is of the small radius of curvature. Thus two identical wheels are used but, according to the invention with the wheels oriented with small-radius edge surfaces facing axially oppositely. Such a system therefore reduces the number of grinding wheels the plant needs to stock.

The cylindrical workpiece surfaces according to the invention are of different axial lengths, and the axial lengths of the cylindrical surfaces are at most equal to the longest axial length of the longer of the cylindrical workpiece surfaces. Furthermore according to the invention the axes of the grinders and the main axis are coplanar.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
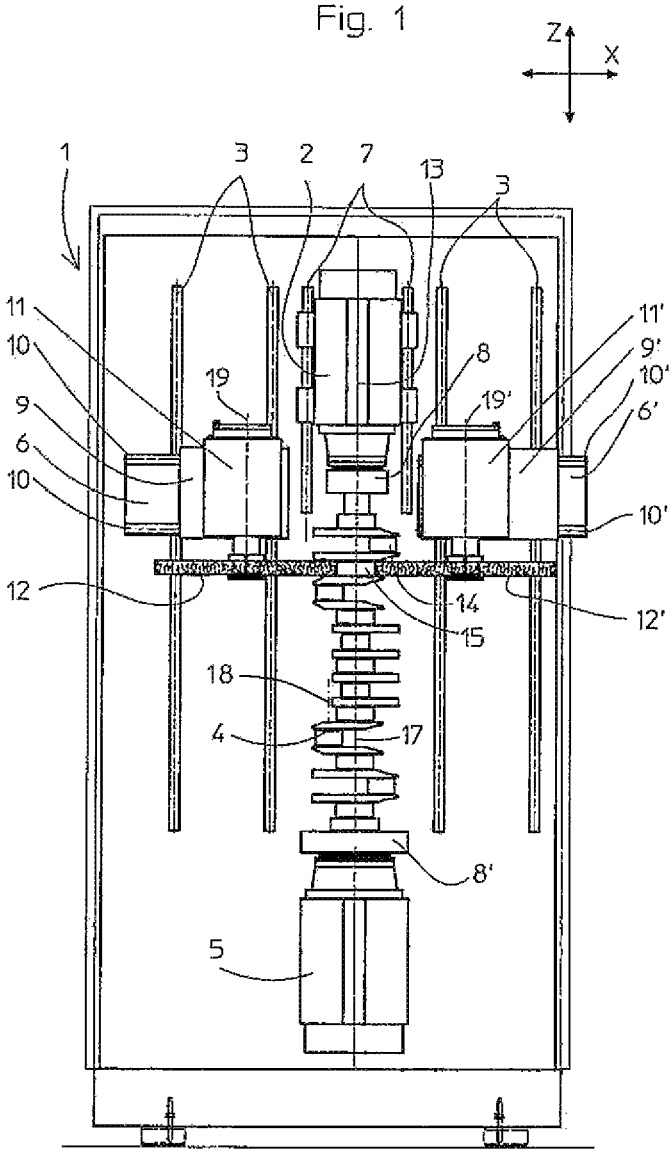
FIG. 1 is a small-scale view of a crankshaft-grinding machine according to the invention.

As seen in FIG. 1 a grinding machine has a vertical headstock 2 at the top of a machine frame 1 and a fixed headstock 5 below it. The upper headstock 2 can be moved along guides 7 in order to hold workpieces 4 of various lengths. The workpiece 4 is held at its ends in chucks 8 and 8' of the headstocks 2 and 5, with the result that a spindle axis 13 defined by the chucks 8 and 8' and the workpiece axis 17 can be concentric as illustrated.

The workpiece 4 here is a crankshaft with main bearings 15 all centered on the main crankshaft axis 17 and each having a cylindrical central workpiece surface 20' of a short axial length C' and flanked by a pair of arcuately rounded and annular corner surfaces 21' of large radius of curvature. A plurality of crankpins 14 are centered on respective axes 18 offset from and parallel to the axis 17 and each have a cylindrical central workpiece surface 20 of a long axial length C and flanked by a pair of arcuately rounded and annular corner surfaces 21 of small radius of curvature. All the surfaces 20, 20', 21, and 21' have to be ground very smooth and to very tight tolerances.

The chucks 8 and 8', as described in copending application Ser. No. 12/777,294 filed 11 May 2010 and whose entire disclosure is herewith incorporated by reference, can shift the workpiece 4 perpendicular to the axes 13 and 17 to align any one of the axes 14 or the axis 17 with the rotation axes of the headstocks 3 and 5.

Two grinders 11 and 11' on diametrally opposite sides of the workpiece 4 and in FIG. 1 are both shown engaged with a main bearing 15 of the crankshaft 4. They are carried on and movable horizontally and vertically by respective slide assemblies 6, 9 and 6', 9'. More specifically, the grinder 11, which is essentially identical to the grinder 11', is carried on a slide 9 that can move on horizontal guide rails 10 of a slide 6 that can ride on vertical rails 3 fixed to the machine frame 1 with appropriate vertical and horizontal actuators responsible for the vertical movement (direction Z) of the slide 6 and the horizontal movement of the slide 9. The grinding wheels 12 and 12' driven by the grinders 11 and 11' are carried on the lower ends of output shafts of the respective grinders 11 and 11' and rotated about respective vertical axes 19 and 19' parallel to the spindle axis 13.

An essential characteristic of the invention is seen in that even when grinding workpieces 4 that are of complex shape, where the shapes of the grinding disks 12 and 12' conform to the shape of the workpiece 4, the cylindrical surfaces 20 and 20' are machined according to the synchronous grinding method, where two grinding disks 12 and 12' are set diametrally opposite each against the workpiece, in opposite directions, so that their normal force components cancel each other out. In this manner, crankshafts 4 having different radii of curvature at the main bearings 15 and the crankpin 14 can be machined.

Figure 2:
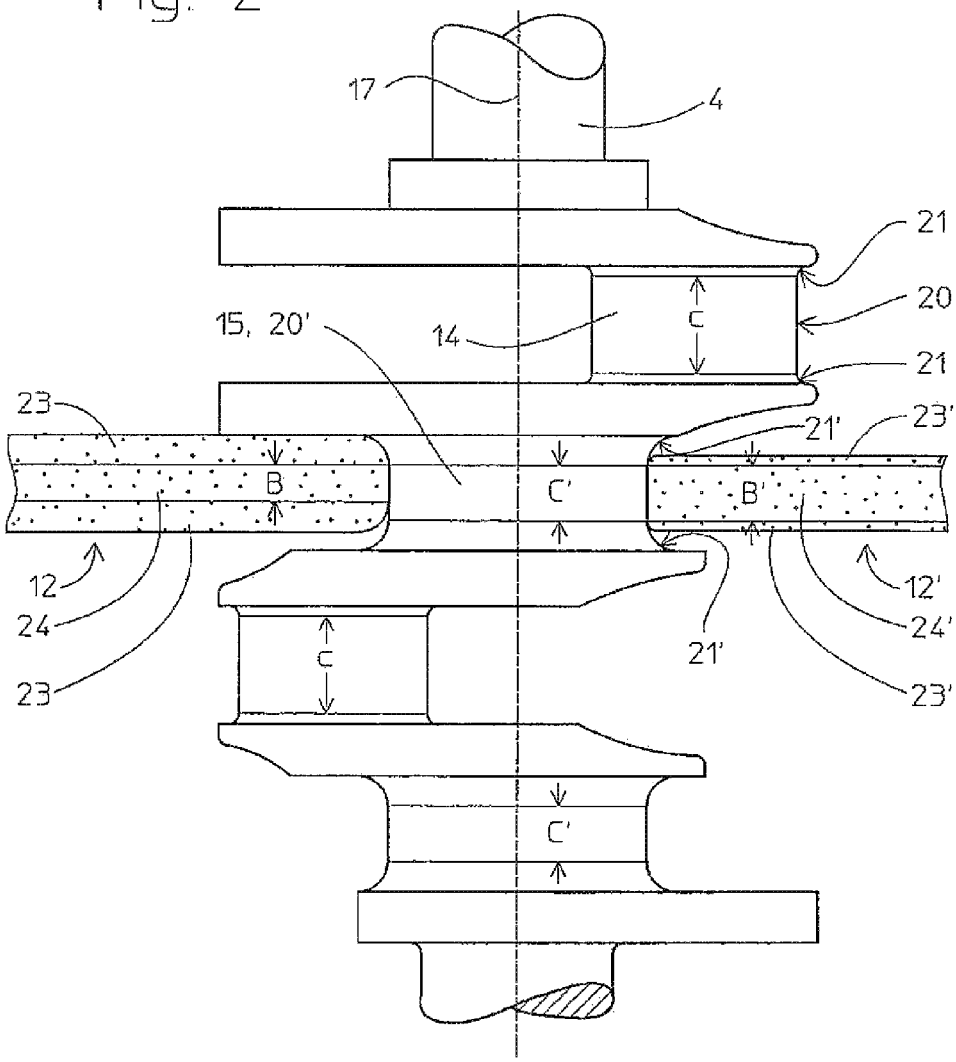
FIGS. 2 and 3 are large-scale detail views showing the method of this invention using two differently shaped and symmetrical grinding disks.

FIG. 2 shows the machining of one of the main bearings 15 by two grinding disks 12 and 12' that have respective central cylindrical surfaces 24 and 24' of respective different axial widths B and B' and flanked by arcuately rounded edge surfaces 23 and 23' for grinding radii or similar curved shapes. Thus the disk 12 is substantially thicker than the disk 12' overall, but its central region 24 is thinner than the region 24', so that B<B', and the edge surfaces 23 are of large radius of curvature than the edge surfaces 23'. The central cylindrical surfaces 24 and 24' are simultaneously in engagement with the workpiece. The grinding disks 12 and 12' bear in opposite directions diametrally oppositely to the center axis 17 of the main bearing 15, so that their normal force components cancel one another out.

The outside shapes of the grinding disks 12 and 12' are adapted to the shapes of the main bearings 15 and crankpins 14, i.e. neither of the widths B and B' of the cylindrical surfaces 24 and 24' is wider than the smaller of the widths C and C' of the cylindrical journal surfaces 20 and 20' of the crankpins 14 or of the main bearings 15 that have to be machined. The shapes of the edge surfaces 23 of the grinding disk 12 precisely correspond to those of corners 21' so that the corners 21' can be machined exclusively with the grinding disk 12. Machining of the surface 20 with the grinding disk 12' is also possible, if the grinding disk 12' is moved along the workpiece shape with the smaller radius of curvature. Similarly the edge surfaces 23' of the grinding disk 12' have the same shape as the surfaces 21 of the crankpins 14.

Thus as shown in FIG. 2 one of the main bearings 15 is machined by pressing the thin disk 12' centrally against the cylindrical outer surface 20' without moving it axially so the central surface 24' that is of the same width B' as the width C' of the surface 20' grinds this surface 20' and the disk 12' makes no contact with the corners 21'. At the same time the thicker disk 12 is also pressed radially oppositely against the surface 20' to machine it and eliminate any bending of the workpiece 4 by the disk 12' while at the same time this disk 12 is shifted at least once axially sufficiently that its edge surfaces 23 are pressed first into one of the corners 21' and then into the other of the corners 21' to machine them also.

Figure 3:
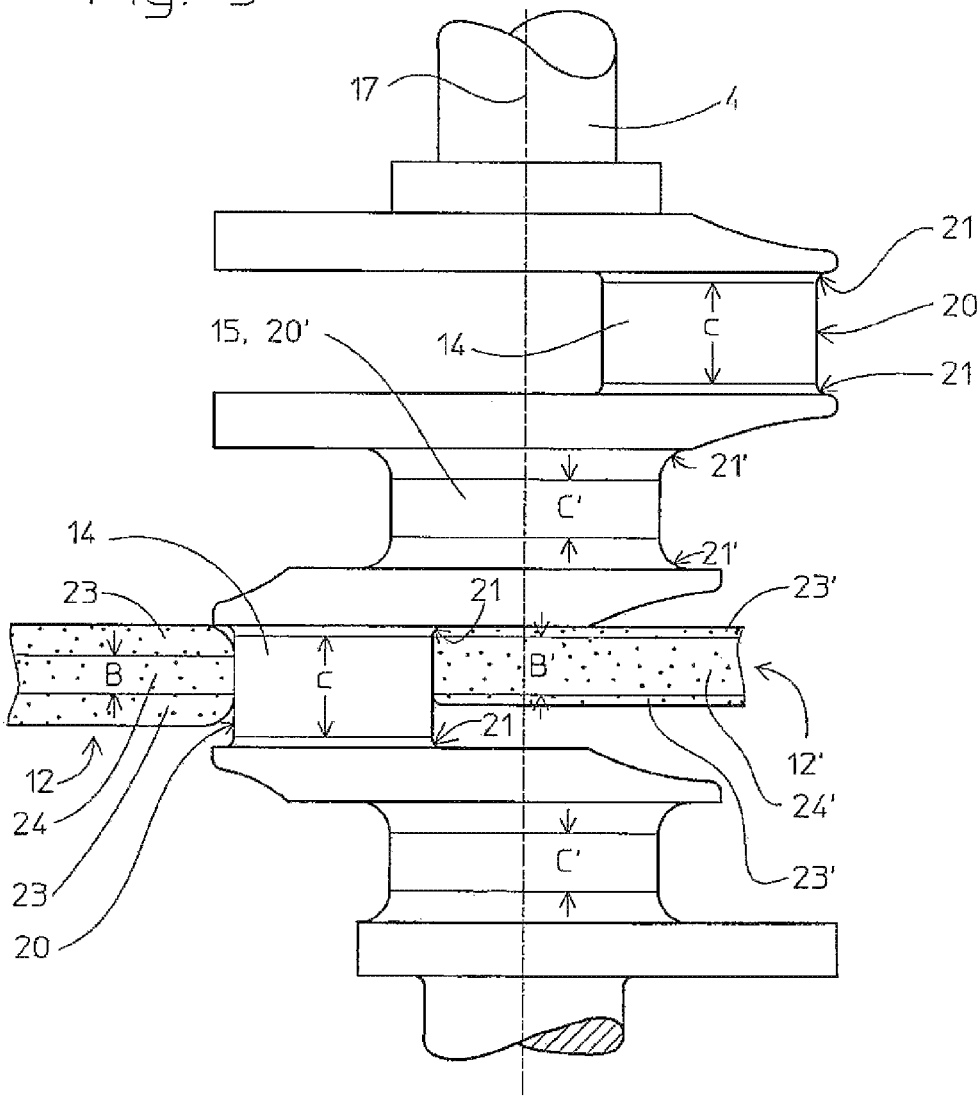

As shown in FIG. 3 one of the crankpins 14 is machined using the same assembly as in FIG. 2 by pressing the thick disk 12 generally centrally against the cylindrical outer surface 20 without moving it significantly axially so the central surface 24 that is of a narrower width B than the width C of the surface 20 grinds this surface 20 and the disk 12 makes no contact with the corners 21. At the same time the thinner disk 12' is also pressed radially oppositely against the surface 20 to machine it and eliminate any bending of the workpiece 4 by the disk 12 while at the same time this disk 12' is shifted axially at least once sufficiently that its edge surfaces 23' are pressed first into one of the corners 21 and then into the other of the corners 21 to machine them also.

Figure 4:
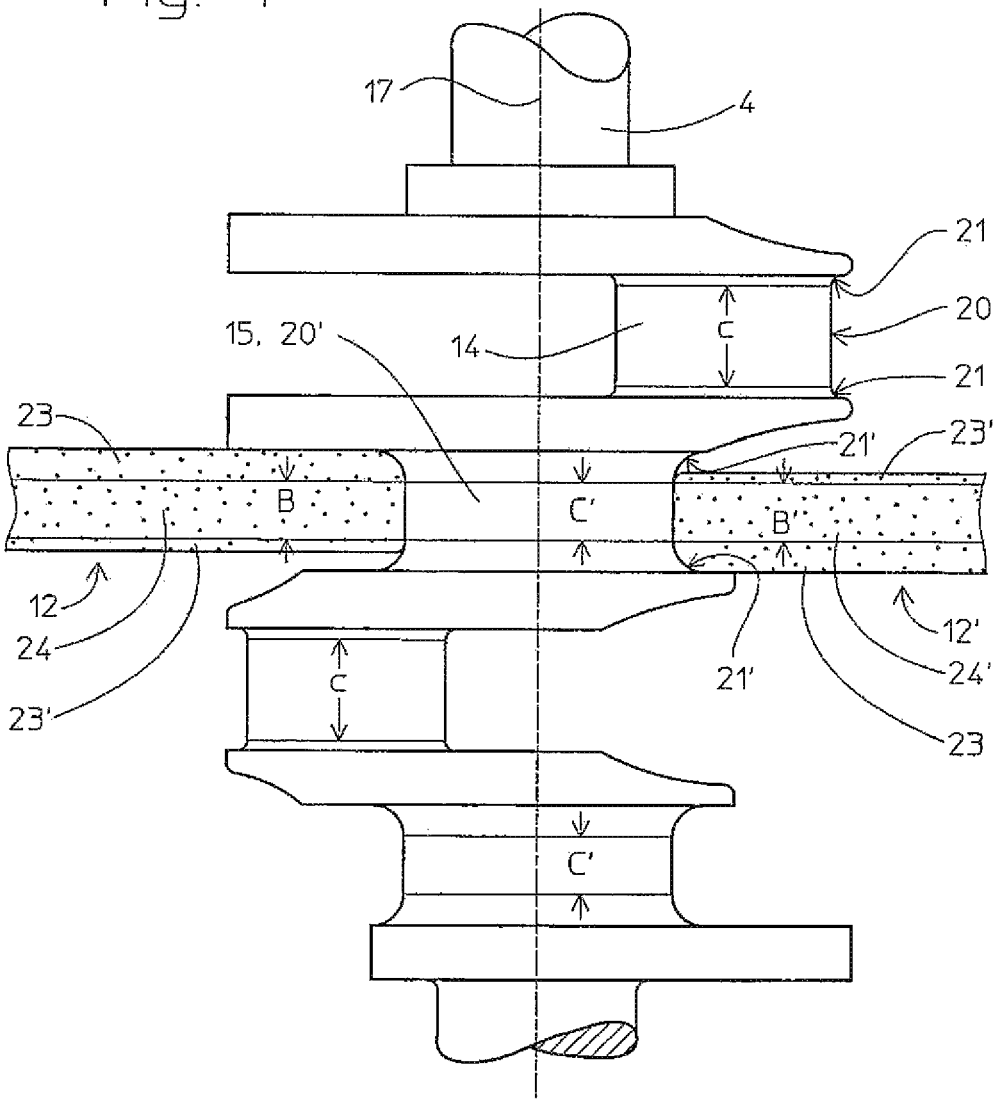
FIGS. 4 and 5 are views like FIGS. 2 and 3 showing the inventive method using two identically shaped but asymmetrical grinding disks.
Figure 5:
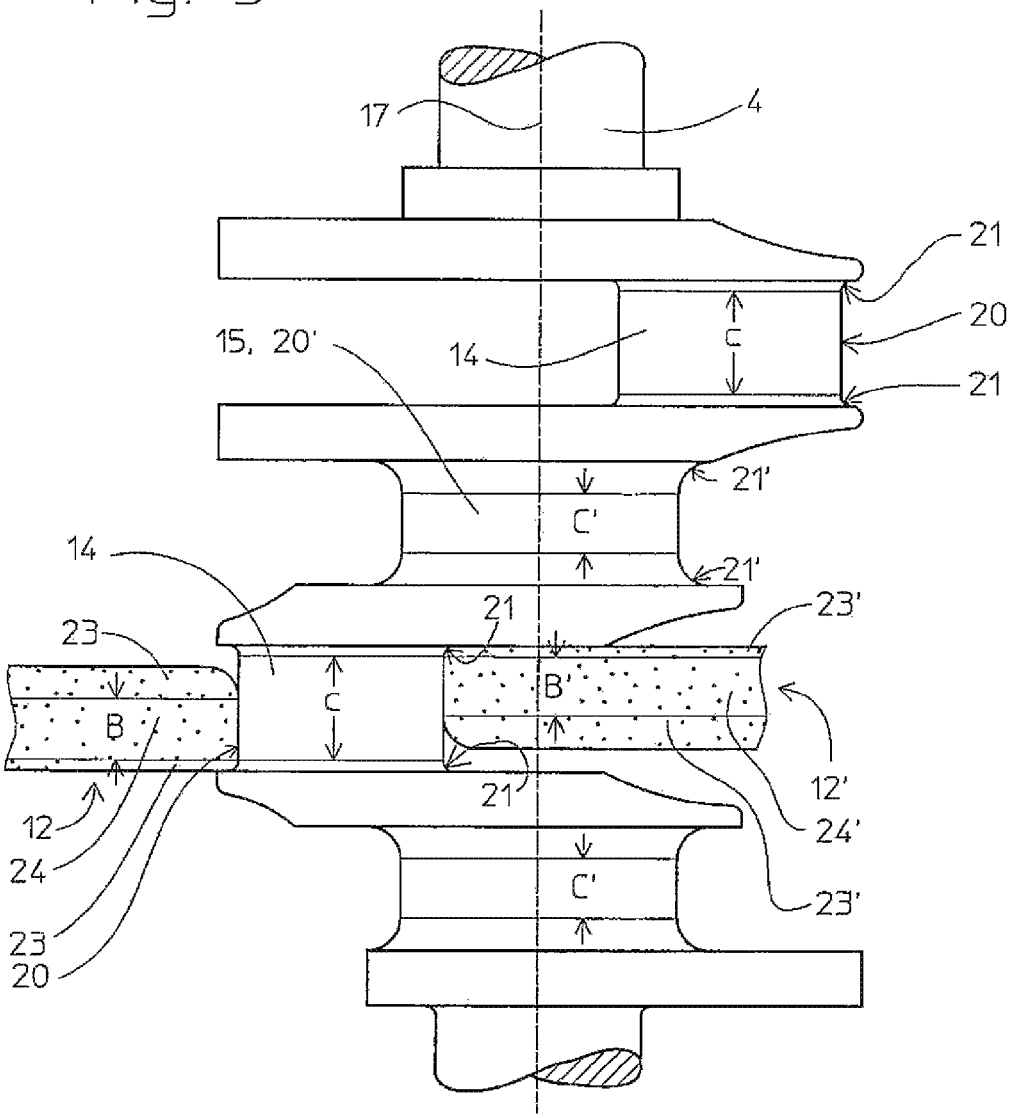

In an advantageous embodiment of the invention according to FIGS. 4 and 5, each of the two grinding disks 12 and 12' has one edge surface 23 having a large radius of curvature, and on the opposite axial side an edge surface 23' having a small radius of curvature, so that in fact these two disks 12 and 12' are identical but asymmetrical. In the grinding disk 12, the edge surface 23 with the large radius is above the respective edge surface 23' with the small radius. The grinding disk 12' is oriented axially oppositely with its large-radius edge surface 23 above its small-radius edge surface 23'. As a result, the shapes of the grinding disks 12 and 12' are point-symmetrical relative to one another.

By offsetting the grinding disks 12 and 12' in opposite directions, the main bearings 15 can be machined as shown in FIG. 4, or the crankpins 14 can be machined as shown in FIG. 5. The grinding disks 12 and 12' are offset relative to one another parallel to the center axis 17, so that both corners 21' are machined at the same time. To machine the crankpin 14 according to FIG. 5, the grinding disks 12 and 12' have been offset in the opposite direction as in FIG. 4, in order to machine the corner 21 with the corresponding edge surface 23'. With the point-symmetrical arrangement of the grinding disk shapes, it is possible to machine bearings having different widths C and C' in a single work step, in a particularly advantageous manner by offsetting the grinding disks 12 and 12' and by simultaneous grinding with both disks 12 and 12'.

More particularly, as shown in FIG. 4 one of the crankpins 14 is machined by pressing both of the disks 12 and 12' diametrally oppositely against it, but with the disks 12 and 12' axially offset from one another so the large-radius edge 23 of the disk 12' fits in and machines one of the corners 21' and the large-diameter wedge 23 of the other disk 12 fits into and machines the other of the corners 21'. Neither disk 12 or 12' has to be moved axially from this position As shown in FIG. 5 one of the main bearings 15 is machined by pressing both of the disks 12 and 12' diametrally oppositely against the surface 20, but axially offset oppositely to the setup of FIG. 4. This way the small-radius edge 23' of the disk 12' fits in one of the corners 21 and the small-radius edge 23' of the other disk 12 fits in other corner 21 to simultaneously machine them both.

We claim:

1. A method of machining a crankshaft having two cylindrical crankshaft surfaces centered on respective parallel axes and each flanked by a pair of arcuately rounded and annular corners also centered on the respective axes, the corners flanking one of the cylindrical crankshaft surfaces having a small radius of curvature and the corners flanking the other of the cylindrical crankshaft surfaces having a large radius of curvature greater than the small radius, the apparatus comprising:

means for holding and rotating the crankshaft about a main axis parallel to the axis of one of the crankshaft surfaces;

a pair of grinders having wheels generally diametrally flanking the crankshaft, each of the wheels being rotatable about a respective wheel axis parallel to the main axis and having a central cylindrical outer wheel surface centered on the respective wheel axis and a pair of arcuately rounded edge surfaces also centered on the respective wheel axis, both of the edge surfaces of one of the wheels having the large radius of curvature and both of the edge surfaces of the other of the wheels having the small radius of curvature; and guide means for moving the grinders parallel to the axes such that the small-radius edge surfaces are pressed axially into the small-radius corners and the large-radius edge surfaces are pressed into the large-radius corners while simultaneously pressing both of the cylindrical outer wheel surfaces diametrally oppositely against the cylindrical crankshaft surfaces.

2. The machining method defined in claim 1 wherein the guide means axially shifts one of the wheels while pressing it radially against the crankshaft.

3. The machine method defined in claim 1 wherein the wheels are oriented with the respective small-radius edge surfaces facing axially oppositely.

4. The machining method defined in claim 1 wherein the cylindrical crankshaft surfaces are of different axial lengths, and the axial lengths of the cylindrical surfaces are at most equal to the longest axial length of the longer of the cylindrical crankshaft surfaces.

5. The machining method defined in claim 1 wherein the axes of the grinders and the main axis are coplanar.

6. The machining method defined in claim 1 wherein the crankshaft has main bearings and crankpins in turn having the cylindrical crankshaft surfaces.

* * * * *